United States Patent [19]

Aho

[11] 4,336,949

[45] Jun. 29, 1982

[54] BASKET FOR A SKIPOLE

[76] Inventor: Yrjö Aho, Kuninkaanniemi, 02160 Espoo 16, Finland

[21] Appl. No.: 741,358

[22] Filed: Nov. 12, 1976

[30] Foreign Application Priority Data

Nov. 13, 1975 [FI] Finland ..... 753193

[51] Int. Cl.[3] ..... A63C 11/24

[52] U.S. Cl. ..... 280/824

[58] Field of Search ..... 280/11.37 B, 11.37 P, 280/11.37 N, 11.37 Z

[56] References Cited

U.S. PATENT DOCUMENTS 3,193,300 7/1965 McDonald ..... 280/11.37 Z 3,963,254 6/1976 Aho ..... 280/11.37 Z

*Primary Examiner*—Robert B. Reeves

*Assistant Examiner*—Gene A. Church

*Attorney, Agent, or Firm*—Joseph E. Mueth

[57] ABSTRACT

A basket for a skipole, consisting of a periphery frame and a connecting piece between the pole and the periphery frame, said piece being an axle located in respect to the skiing direction crosswise, and being asymmetrically fastened to the rear of the said frame, said axle being of rubber or soft plastics called elastomer, and fastened without free play to said frame and said pole thus acting between these as an elastic torsion piece.

4 Claims, 8 Drawing Figures

BASKET FOR A SKIPOLE

BACKGROUND OF THE INVENTION

The traditional basket for a skipole consists of a circular peripheral hoop, to which leather straps crossing at the center of the basket have been fastened, and at the crossing point the pole has been fastened. The advantages achieved with this basket are a large surface area and somewhat elastic central area of the basket. For instance, on hard racing tracks the large surface area of the basket is, however, not needed. It may even be harmful because of atmospheric resistance. Furthermore, this traditional type of basket is relatively heavy, expensive and poorly suited for serial production. Therefore, baskets of plastics have lately increasingly replaced this traditional basket type.

The moving over to baskets of plastics have, however, brought along a new disadvantage, namely increasing stiffness of the basket. When inclining the pole forward during poling motion, the front part exerts a counterforce, risking bounding out of the snow of the spike and slipping of the pole backwardly. Further the torsional moment affects the pole over its entire length and bends it, which slows down skiing and causes increased risk of buckling, need of additional dimensioning, and gain in poleweight. Efforts to correct this disadvantage have resulted in expensive and complicated mechanical joint constructions, by which the basket has been fastend to the pole to be as easily turnable as possible. The disadvantages of the mechanical joint constructions are, except that they are expensive, complicated and heavy, also that the joint is slack functioning, and it can very easily get frozen.

An asymmetric basket construction is known by which the drawbacks mentioned, when inclining the pole, can be avoided. But there is a disadvantage; in that when inclining the pole, the use of the entire bearing surface of the backet is not achieved.

SUMMARY OF THE INVENTION

Briefly, this invention comprises a basket for a skipole, consisting of a periphery frame and a connecting piece between the pole and the periphery frame, said piece being an axle located in respect to the skiing direction crosswise, and being asymmetrically fastened to the rear of the said frame, said axle being of or soft plastics called elastomer, and fastened without free play to said frame and said pole thus acting between these as an elastic torsion piece.

The object of this invention is a basket of plastics for a skipole, consisting of a periphery frame and a connecting piece between these, that is an axle crosswise to the skiing direction, and asymmetrically fastened to the rear of the front edge of the basket frame.

It is the main object of this invention to improve this kind of plastic basket, thus that the same advantages the mechanical joint has, are obtained, but avoiding the drawbacks of the joint. The mechanical tender joint is not at all suitable for the asymmetric basket, which is the starting point for this invention.

This purpose is achieved by the invention by virtue of the fact that the axle is made of rubber or soft plastics, so called elastomer, and is fastened to the periphery frame and pole without free play, acting as an elastic torsion piece between these. The desired elastic properties can be given this type of basket construction by proper selecting of material and cross-section surface area. The elastic axle according to the invention is thus acting as a torsion piece, e.g. its center turns around the longitudinal axis when inclining the pole and leaning the basket against some base. However, the axle is stiff enough to prevent unadaptable turning of the basket in the pole direction, in which case the basket would not form a bearing surface but would sink in the snow. All the parts of the basket according to the invention can be manufactured by injection molding of plastics, accordingly its manufacturing cost is low and its construction simple. According to the advantageous embodiment of the invention the connecting piece is detachably fastened at its ends to the periphery frame of the basket. Owing to the changeability of the connecting piece or axle, an axle of proper stiffness can be selected for different snow conditions, e.g. through alternatives of the torsional stiffness of the axle the functioning of the basket can be regulated. At the same time it will be possible to change basket frames with different size and shape. For instance, on soft tracks, with a larger basket, a tender deformed axle is preferred, with only a little asymmetric location on the basket. On hard tracks, with a smaller basket, a stiffer axle is preferred, with a considerably asymmetrical location on the basket.

DETAILED DESCRIPTION OF THE DRAWINGS

Turning to the drawings.

Figure 1:
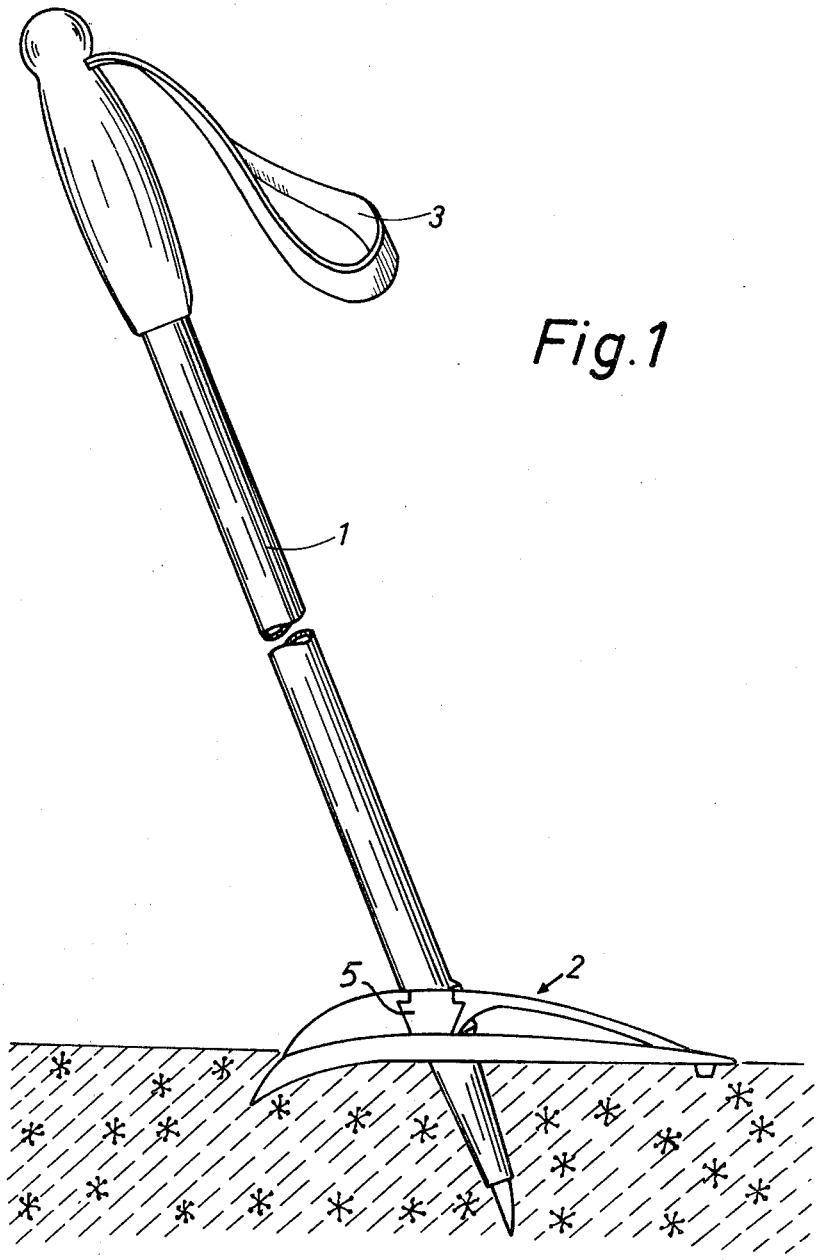
FIG. 1 shows a basket attached to a skipole, according to the invention, viewed in action.

The basket 2 is attached to the lower end of the pole 1, and to the upper end is attached the handstrip 3, the location of which determines the pole position when skiing. The basket 2 consists of the periphery frame 4 and the elastic axle 5, which acts as a connecting piece between the pole 1 and frame 4. The direction of the elastic axle 5 is crosswise to the skiing direction, which means, that in FIG. 1 it is vertically to the plane-drawing. When the pole 1 turns in relation to the basket 2, the elastic axle 5 acts as a torsion piece, e.g. its center turns around its own longitudinal axis. The axle 5 may thus be of comparatively strong and elastically stiff material, in spite of which the torsion moment, e.g. the phase by which the turning of the pole is counter-forced, will not increase. The pole 1 has been fastened by means of the ferrule 6 to the hole 7 of the connecting piece 5, in which hole the ferrule 6 grasps lockwise without rotating and without moving axially. At the ends of the connecting piece 5 there are widenings 8, by means of which the connecting piece grasps into the locking slots 9 on the basket frame. The locking slots 9 are open to the upper surface of the basket frame, and they extend in radial direction outwards corresponding to the widenings 8 on the axle. The axle 5 may be located on its place by extending as long as the widenings 8 are, or by bending the basket frame 4.

Figure 2:
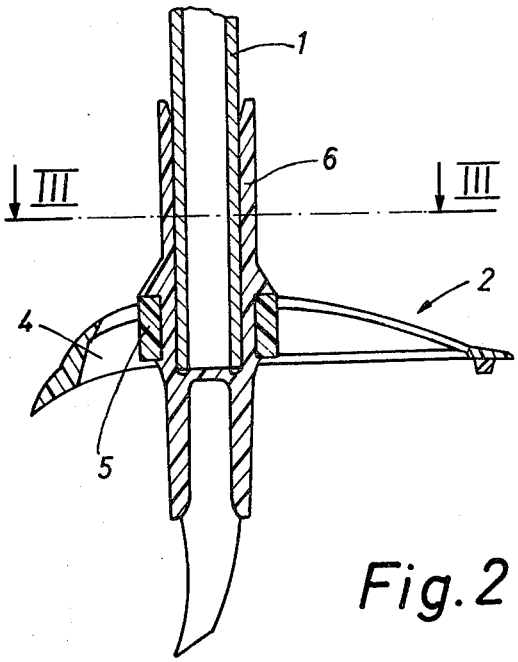
FIG. 2 shows a basket, according to the invention, attached to a skipole, in vertical view, taken as a section along line II—II, in FIG. 3.
Figure 3:
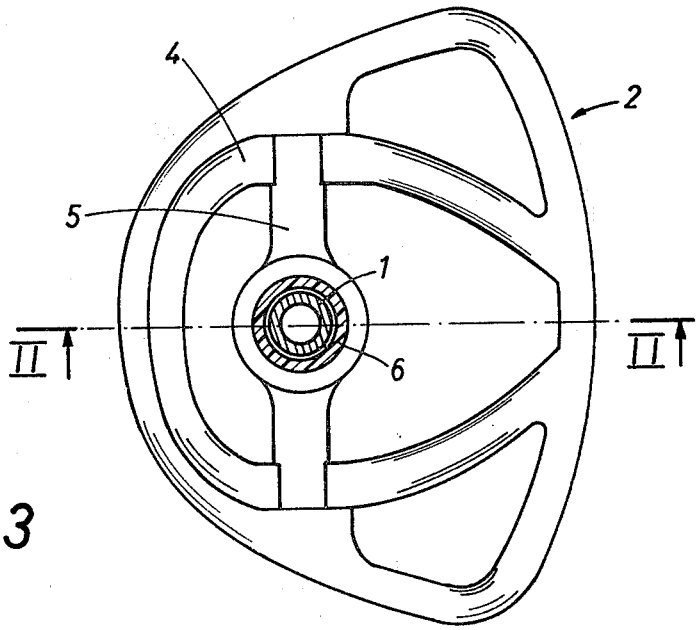
FIG. 3 shows a basket according to the invention viewed from above, taken as a section along line III—III in FIG. 2.
Figure 4:
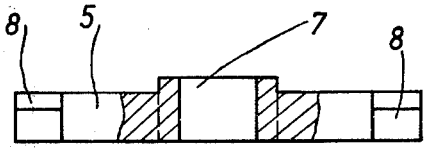
FIG. 4 shows a connecting piece or an elastic axle according to the inventon, viewed from side.
Figure 6:
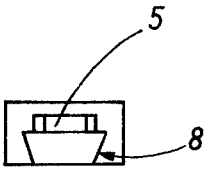
FIG. 6 shows the same viewed from the short end.
Figure 5:
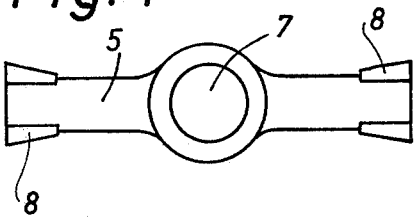
FIG. 5 shows the axle viewed from above.
Figure 7:
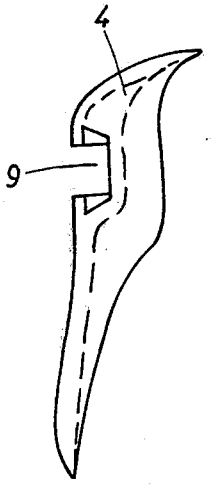
FIG. 7 shows a periphery frame according to the invention according to one of the embodiments of the invention, viewed from side.
Figure 8:
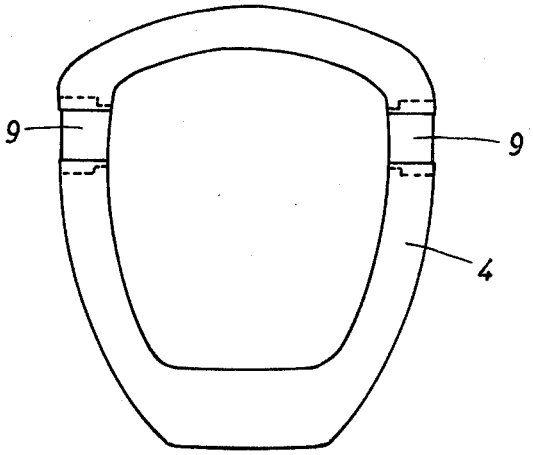
FIG. 8 shows the same viewed from above.

The basket according to FIG. 2 and 3, is meant for soft snow conditions, and therefore it is larger, and regarding the location of the axle 5, it is more symmetric than the basket according to FIG. 7 and 8, which is meant for hard snow conditions.

Having fully described the invention it is intended that it be limited only by the lawful scope of the appended claims.

I claim:

1. A basket for a skipole with hard straps comprising a rigid periphery frame and a sole connecting piece between said skipole and the periphery frame, said sole connecting piece being an axle having an axis perpendicular to said skipole, and being asymmetrically fastened at both of its ends to said frame forwardly of the center of said frame without free play and tautly bridging said frame, said axle being of rubber or soft plastic, and said axle thus acting between the frame and the skipole as an elastic torsion piece whereby said skipole can be rotated back and forth about said axis of said axle without moving said frame.

2. The basket as defined in claim 1, wherein said connecting piece is detachably fastened to said periphery frame, thus allowing its use in different sizes of frames.

3. The basket as defined in claim 1 wherein said connecting piece is wider at both of its ends, and locking slots are provided in the periphery frame, said wider ends being received in said slots.

4. The basket as defined in claim 1 wherein a hole adapted to receive a ferrule and the skipole is provided at the mid-point of said connecting member.

* * * * *